United States Patent [19]

Breuers et al.

[11] Patent Number: 4,492,138

[45] Date of Patent: Jan. 8, 1985

[54] APPARATUS FOR DELIVERING WEB MATERIAL OR THE LIKE FROM ROLLS

[75] Inventors: Theo P. C. Breuers, Venlo; Andreas T. Heijnen, Tegelen; Arie Leppink, Venlo, all of Netherlands

[73] Assignee: Océ-Nederland B.V., Venlo, Netherlands

[21] Appl. No.: 472,145

[22] Filed: Mar. 4, 1983

[30] Foreign Application Priority Data

Mar. 10, 1982 [NL] Netherlands ..... 8200980

[51] Int. Cl.[3] ..... G03B 27/14

[52] U.S. Cl. ..... 83/203; 83/272; 83/553; 83/650

[58] Field of Search ..... 83/650, 272, 553, 203; 242/55.42, 55.3, 56 A; 226/110; 355/13

[56] References Cited

U.S. PATENT DOCUMENTS 3,373,644 3/1968 Bielland ..... 83/650

3,507,178 4/1970 Lamon et al. ..... 83/650 X 3,821,917 7/1974 Hatanaka ..... 83/650 X

*Primary Examiner*—James M. Meister

*Attorney, Agent, or Firm*—Albert C. Johnston

[57] ABSTRACT

An apparatus for delivering web material or the like from rolls comprises a rotatable holder that holds a plurality of web supply rolls and for each roll is provided with a separate support member for supporting the free end of a portion of the web unwound from the roll. The roll holder is movable between a plurality of positions in each of which one of the supply rolls is in an active position at a location where a portion of its web can be unwound and transported over a cutting edge provided on the related support member, and where a cutting element separate from the holder can be operated to cut off a sheet of required length from the unwound material of the positioned supply roll by cooperation with the related cutting edge.

7 Claims, 3 Drawing Figures

APPARATUS FOR DELIVERING WEB MATERIAL OR THE LIKE FROM ROLLS

This invention relates to an apparatus for delivering web material or the like from a plurality of supply rolls. More particularly, the invention is directed to an apparatus comprising a holder for the web supply rolls that is movable to each of a plurality of positions in each of which one of the supply rolls is in an active position with the free end of its web material disposed at a certain fixed location where a cutting means is operable to cut off a sheet from the web material.

An apparatus of this kind is known, for instance as disclosed in UK Patent Specification No. 1 103 928, in which a holder for delivering web material from three supply rolls is rotatable about a central axis and is provided with separate guides for the respective portions of web material that can be unwound from the supply rolls. These guides extend radially outward to the surface of revolution of the holder. By rotation of the holder, each roll can be brought into a position in which the material of the roll can be unwound and the unwound web material discharged along the guide associated with that roll. A sheet can then be cut off from the unwound web material by a cutting device disposed at a fixed location adjacent the roll holder. This cutting device consists of a fixed support plate having a cutting edge with which the section of the web material that is to be cut off can come into contact, and of a movable knife that can cut through the web along the cutting edge.

The roll holder of that known apparatus is provided with means for withdrawing the free end of the web material after a sheet has been cut off from the web. Such withdrawal must always be effected before the holder is brought into another position, in order to prevent the free end of the web material from coming into contact with parts of the cutting device during rotation of the holder. Specifically, the web material must be withdrawn a distance equal to or greater than the thickness of the part of the cutting device that is situated between the cutting zone and the surface of revolution of the holder, and a special mechanism is required for effecting such withdrawal.

One disadvantage of the apparatus employing a web withdrawing mechanism is that inaccuracies can readily occur in the position of the free end of the web material, e.g. as a result of uncontrolled slip during withdrawal of the protruding end portion of the web. Such inaccuracies may cause differences in the size of the sheets that are subsequently cut off from the web.

Another disadvantage of such an apparatus is that the time required for withdrawal of the web material adversely affects the frequency at which sheets can be cut off from the webs of different rolls.

A principal object of the present invention is to provide an apparatus for delivering web material or the like from a plurality of supply rolls with avoidance of the inaccuracies and operating delays of the known apparatus described above.

According to the present invention, an apparatus for delivering web material or the like comprises a movable holder for holding a plurality of supply rolls, which holder comprises for each of the rolls a support means that supports an unwound portion of the related web material and is provided with a cutting edge lying at and transverse to the path of transport of such web material; and the holder is rotatable to any of a plurality of positions in each of which one of the supply rolls is in an active position, at a certain fixed location, where the cutting edge of the related support means is so disposed that a cutting element can cooperate with it to cut off a sheet from unwound web material of the roll that is in the active position.

Preferably, the cutting element is part of a cutting means disposed outside the path of movement of the holder and adjacent to the fixed location so that the cutting element can cooperate with each of the cutting edges. As a result, in an apparatus according to the present invention, only one cutting element is required for cutting off sheets from any of the webs when the respective roll is in the active position.

Other features and advantages of the invention will become apparent from the following detailed description of a preferred embodiment and the accompanying drawings thereof. In the drawings.

Figure 1:
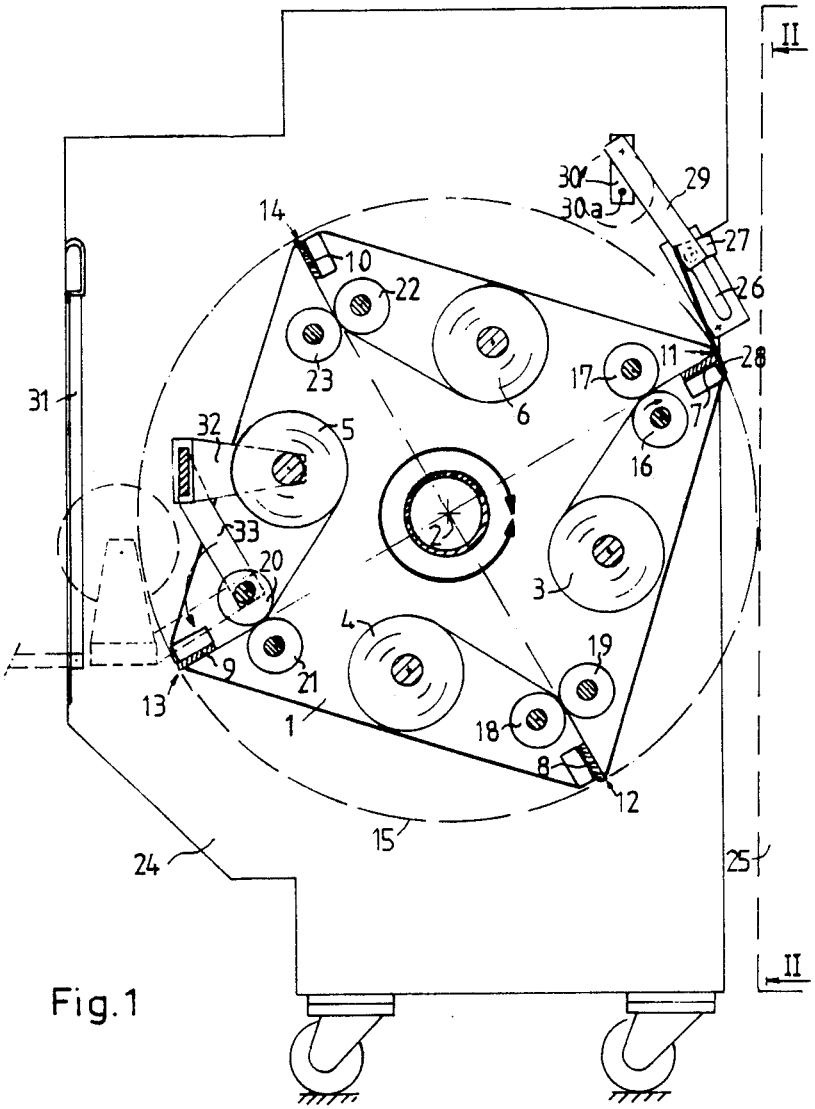
FIG. 1 is a side elevational view, partly in section, of an apparatus in accordance with the present invention for delivering web material from a plurality of supply rolls.

As indicated in FIG. 1, the illustrated embodiment of the present invention comprises a holder 1 that is rotatable about a fixed axis 2 and in which four supply rolls 3, 4, 5 and 6 of web materials or the like are mounted so as to be freely rotatable. The axes of rotation of the supply rolls are spaced equidistantly on the circumference of a cylinder having the axis 2 as its center line. Four support means 7, 8, 9 and 10 are fixed in the rotatable holder 1, each to guide web material or the like being unwound from one of the respective supply rolls 3, 4, 5 and 6. Each support means is provided along its outer side with a cutting edge 11, 12, 13 or 14, respectively, that lies at and extends transversely of the path of the web unwound from the related supply roll. The cutting edges 11, 12, 13 and 14 are spaced equidistantly on the circumference 15 of a cylinder inscribed by rotation of the holder.

The rotatable holder further comprises four pairs of rollers 16-17, 18-19, 20-21 and 22-23, by means of which the web materials can be unwound and transported from the respective supply rolls 3, 4, 5 and 6. Each pair of rollers consists of a drivable roller 16, 18, 20 or 22, respectively, and a freely rotatable pressure roller 17, 19, 21 or 23, respectively, cooperating therewith.

Figure 2:
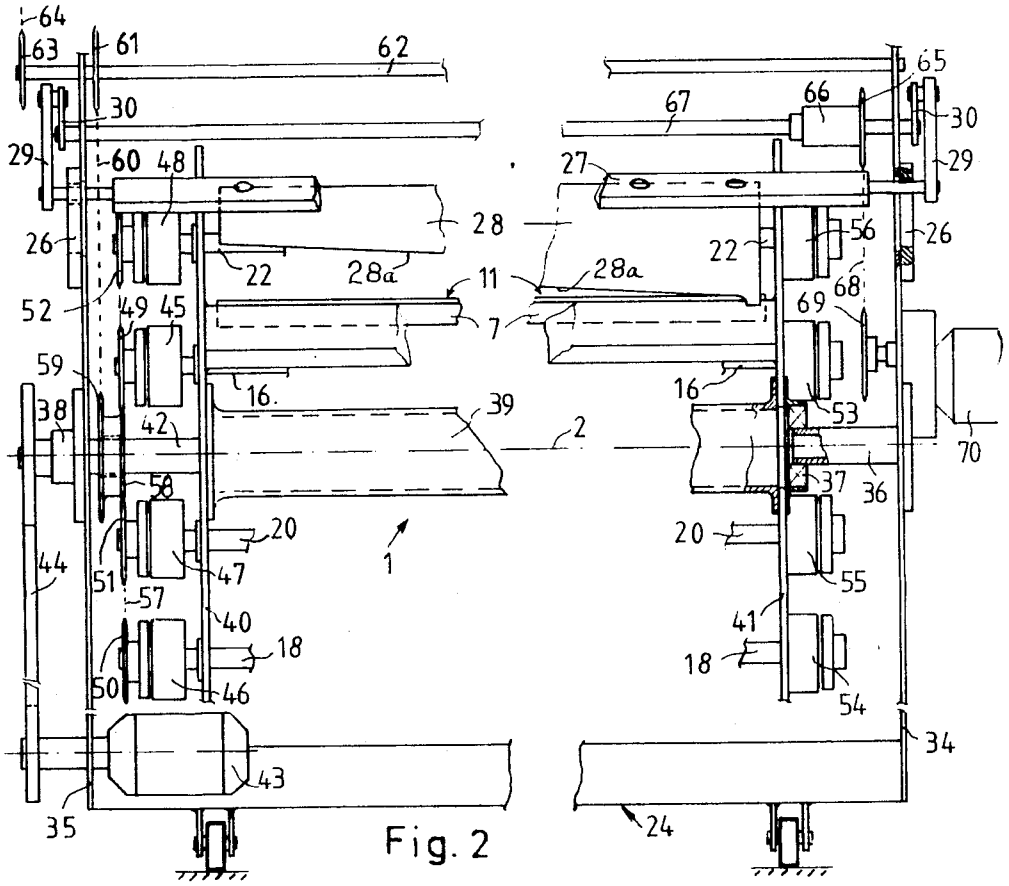
FIG. 2 is an elevational view of the apparatus taken along the line 11—11 of FIG. 1.

The rotatable holder 1 is contained in a frame 24 which is mobile so that it can be positioned next to a machine 25, e.g. a diazotype copying machine, for processing the web or like material. The frame 24 comprises two oppositely disposed side plates 34 and 35, to each of which is fixed a guide 26 for guiding a reciprocating bar 27 and a knife blade 28 secured to the bar 27. Reciprocating movement of the bar 27 and blade 28 is produced via an arm 29 of which one end is pivotably connected to the bar 27 while the other end is pivotably connected to one end of a crank arm 30, the other end of which is fixed as by a pin 30*a* to a rotatable shaft 67 (FIG. 2).

Upon rotation of the shaft 67, the knife blade 28 is moved to and fro in a path substantially tangent to the cylindrical surface 15 of revolution of the holder, which path extends transverse to the cutting edge of any one of the support means in active position (cutting edge 11 as shown in FIG. 1) so that the cutting edge 28*a* of the blade, which is inclined at an acute angle to the cutting edge of the support means, will be moved along the latter with shearing action to cut off a sheet from the web material unwound from the related supply roll (roll 3 as shown in FIG. 1). The cutting movement of the blade as shown in FIG. 2 is downward.

By rotation of the holder 1 about axis 2, any one of the web supply rolls and its related support means can be brought into the active position relative to the path of the knife blade 28, where the web material of the selected roll can be unwound and transported radially outward by action of the related pair of rollers so that a sheet of the required length can be cut off from the material.

To enable the holder to be turned intermittently through an angle of 90° and locked in the position reached, use can be made of a Maltese cross mechanism (not shown) or of switches disposed along the path of the holder and adapted to interrupt and lock the drive thereof when actuated.

When a supply roll is in a position in which the web material can be unwound and cut off, as is supply roll 3 in FIG. 1, the opposite supply roll (supply roll 5 in FIG. 1) is then situated in a position in which it can be replaced via an access door 31 disposed in frame 24. As shown in FIG. 1 only in the case of supply roll 5, each supply roll is pivotally secured between arms 32 which are mounted slidably on the cross member of a yoke having arms 33 that normally are latched in a position as shown in full lines. Upon being unlatched, the arms 33 can be pivoted about the axis of a roller corresponding to roller 20 so as to swing the yoke and the roll supported on it into the position shown in dash lines. In this latter position, the arms 32 can be slid apart along the cross member of the yoke to enable removal of a supply roll and insertion of another supply roll.

Figure 3:
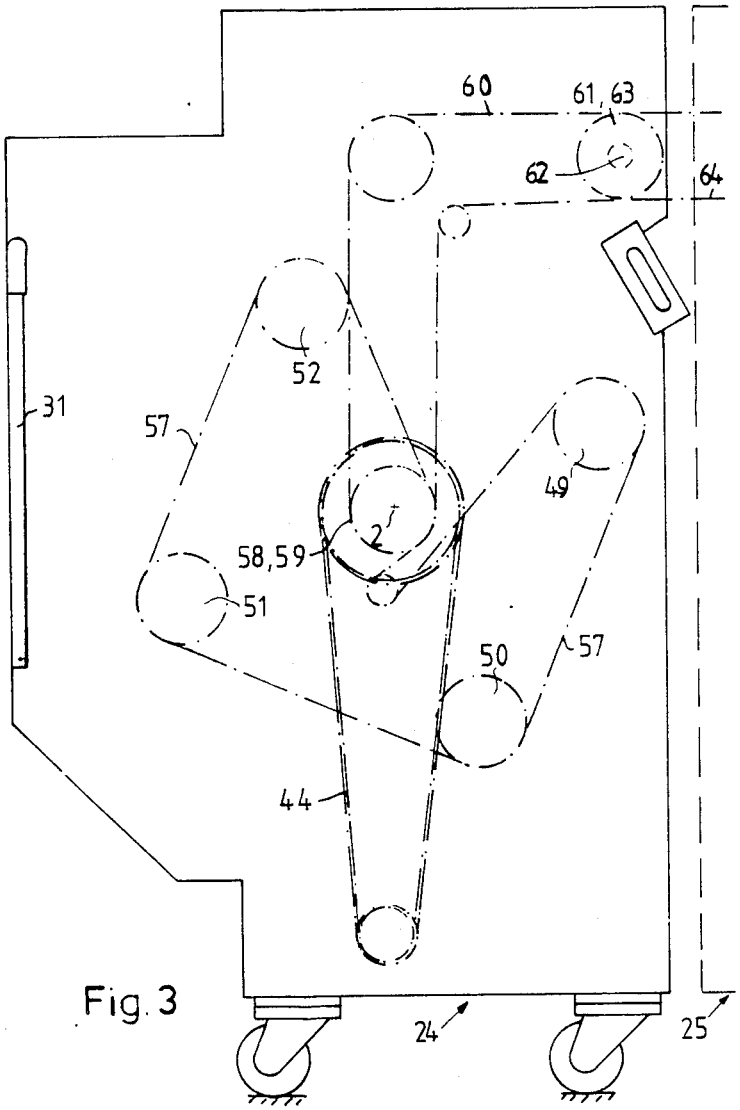
FIG. 3 is a schematic representation in elevation of a drive for the movable parts of the apparatus.

An apparatus construction with a drive system suitable for operating the holder 1 of FIG. 1 is illustrated in FIGS. 2 and 3 of the drawings. As there shown, a journal 36 supporting a bearing 37 is secured to the side plate 34 of frame 24, and a bearing housing 38 is secured to the opposite side plate 35. The holder 1 comprises a central tube 39 having two axially spaced end members such as flange plates 40 and 41 fixed to its opposite ends. A stub shaft 42 projecting from plate 40 is rotatably received in the bearing housing 38, and a sleeve fixed to plate 41 houses the bearing 37 on journal 36. The holder 1 can be rotated by a motor 43 which is connected to the stub shaft 42 via a transmission 44. The drivable web transport rollers 16, 18, 20 and 22 extend between and are mounted in bearings provided in the rotatable flange plates 40 and 41, as shown in FIG. 2. FIG. 2 omits showings of the pressure rollers 17, 19, 21 and 23 and the supply rolls 3, 4, 5 and 6.

The drivable rollers 16, 18, 20 and 22 have one of their ends connectable via electromagnetic clutches 45, 46, 47 and 48, respectively, to sprocket wheels 49, 50, 51 and 42, respectively. The other ends of those rollers are connected to electromagnetic brakes 53, 54, 55 and 56, respectively, for stopping any of those rollers that is disconnected from the drive. As shown in FIG. 3, an endless chain 57 is passed over the sprocket wheels 49, 50, 51 and 52 and also over a sprocket wheel 58 that is freely rotatable about stub shaft 42, thus connecting these wheels for synchronous movement together. Another sprocket wheel 59 is rigidly secured coaxially to sprocket wheel 58 so as to be freely rotatable about shaft 42, and also is connected by a chain 60 to a sprocket wheel 61 on a shaft 62 that extends between and is rotatable in bearings in the frame plates 34 and 35.

The same shaft 62 has a sprocket wheel 63 secured to it and connected via a chain 64 to a drive means (not shown). This drive means, for example, may be the drive of the machine 25 disposed next to the web delivering apparatus for processing sheets cut from the delivered web material.

The web cutting means of the apparatus is actuated by connecting a driving sprocket wheel 65, via a one-revolution electromagnetic clutch 66, to the shaft 67 to which the crank arm 30 is fixed. The clutch 66 is kept active during one revolution. The sprocket wheel 65 is driven by a motor 70 via speed reduction gearing and a sprocket wheel 69 connected with wheel 65 by a chain 68.

The power to the electromagnetic clutches and brakes and to other electrical components of the apparatus comprising rotatable holder 1 can be supplied via an electrical cable which can be led through a hollow journal 36 into the tube 39 and then through an opening in that tube to the connection points. To avoid excessive twisting of the cable inside the tube, the direction of consecutive rotations of the holder 1 is controlled so that the angle through which the holder is rotated with respect to the initial position is limited to a maximum of, for example, 360°. Control circuitry suitable for this purpose is considered to be known per se, so is not illustrated or further described herein.

We claim:

1. An apparatus for delivering web material or the like from rolls, comprising a movable holder having thereon means for holding a plurality of supply rolls of such material and, for each of said rolls, means for unwinding a portion of the web material and transporting the unwound portion along a path separate from the paths of materials unwound from the other rolls, said holder being movable to any of a plurality of positions in each of which one of said rolls is in an active position with the free end of its web material at a certain fixed location, said holder comprising for each of said rolls a support means adapted to support the free end of an unwound portion of the related web material, each said support means being provided with a cutting edge lying at and transverse to the path of transport of such web material, and web cutting means mounted outside the path of movement of said holder and including a cutting element operable to cut off sheets by cooperation with any of said cutting edges when the related supply roll is in said active position.

2. An apparatus according to claim 1, said holder being rotatable about a fixed axis and said cutting edges being located in a common surface of revolution.

3. An apparatus according to claim 2, said holder comprising end members axially spaced apart, each of said supply rolls being carried rotatably on arms mounted between said end members, said unwinding and transporting means comprising for each of said rolls a pair of rollers which extend between said end member for engagement with web material unwound from the related roll and are rotatable to transport such web material radially outward over the related support means, said cutting element being a knife blade movable in a path substantially tangent to said surface of revolution.

4. An apparatus for delivering web material or the like from rolls, comprising a holder rotatable about a fixed axis and having end members axially spaced apart with a plurality of supply rolls of such material rotatably carried on respective arms mounted between said end members, said holder comprising for each of said rolls a support means adapted to support the free end of web material unwound from the related roll and a pair of rollers for engagement with such unwound web material and rotatable to transport the material radially outward over the related support means, each said support means being provided with a cutting edge along its outer side and the several cutting edges being located on a common surface of revolution, said holder being rotatable to any of a plurality of positions in each of which one of said supply rolls is in an active position with the free end of its web material at a certain fixed location, and web cutting means mounted adjacent to said location and outside the path of rotation of said holder, said cutting means including a knife blade movable in a path substantially tangent to said surface of revolution and operable when any of said supply rolls is in said active position, by cooperation with the related cutting edge, to cut off a sheet from web material transported from the related roll.

5. An apparatus according to claim 4, each said cutting edge lying substantially parallel to the axis of said roller, said knife blade having a cutting edge inclined at an acute angle to the cutting edge of any said support members in active position, said cutting means including means for reciprocating said blade in a said path extending transverse to such cutting edge.

6. An apparatus according to claim 5 and further comprising drive means including a system of chains and sprockets for synchronously driving respective drivable rollers of said pairs of rollers, electromagnetic clutch means for selectively connecting each of said drivable rollers with and disconnecting the same from said driving system, electromagnetic brake means connectable with each of said drivable rollers to prevent rotation thereof when the said clutch means thereof is disconnected, and means including a one revolution electromagnetic clutch for connecting said blade reciprocating means with said driving system when a desired length of web material has been transported from a said supply roll in active position over the related support means.

7. An apparatus according to claim 4, the said arms carrying each of said supply rolls being parts of a roll support structure mounted pivotably on shaft portions of a roller of the said pair of rollers related to such roll, each said support structure being swingable about the axis of such roller when the related roll is at a location away from said active position, to bring the related roll outside said end members for replacement.

* * * * *